US012539443B2

(12) United States Patent
Fink et al.

(10) Patent No.: US 12,539,443 B2
(45) Date of Patent: Feb. 3, 2026

(54) EXERCISE MACHINES FOR WEIGHT TRAINING

(71) Applicant: Life Fitness, LLC, Rosemont, IL (US)

(72) Inventors: Jeremy L. Fink, Anoka, MN (US); John R. Lindemeier, Oak Grove, MN (US)

(73) Assignee: Life Fitness, LLC, Rosemont, IL (US)

( * ) Notice: Subject to any disclaimer, the term of this patent is extended or adjusted under 35 U.S.C. 154(b) by 245 days.

(21) Appl. No.: 18/454,153

(22) Filed: Aug. 23, 2023

(65) Prior Publication Data

US 2024/0293696 A1 Sep. 5, 2024

Related U.S. Application Data

(60) Provisional application No. 63/449,353, filed on Mar. 2, 2023.

(51) Int. Cl.

| | |
|---|---|
| ***A63B 22/00*** | (2006.01) |
| ***A63B 21/00*** | (2006.01) |
| ***A63B 21/062*** | (2006.01) |
| ***A63B 22/20*** | (2006.01) |

(52) U.S. Cl.

CPC .... *A63B 22/0089* (2013.01); *A63B 21/00181* (2013.01); *A63B 21/0628* (2015.10); *A63B 21/154* (2013.01); *A63B 2022/206* (2013.01); *A63B 2208/0228* (2013.01); *A63B 2225/09* (2013.01)

(58) Field of Classification Search

CPC ..... A63B 22/0076; A63B 22/0087; A63B 22/0089

See application file for complete search history.

(56) References Cited

U.S. PATENT DOCUMENTS

| | | | | |
|---|---|---|---|---|
| 5,554,086 | A | 9/1996 | Habing | |
| 7,727,128 | B2 | 6/2010 | Giannelli et al. | |
| 8,262,543 | B1 * | 9/2012 | Batca | A63B 21/4045 482/93 |
| 10,391,351 | B2 * | 8/2019 | Carter | A63B 23/03541 |

(Continued)

FOREIGN PATENT DOCUMENTS

| | | | | |
|---|---|---|---|---|
| EP | 4424388 | A1 * | 9/2024 | A63B 21/154 |
| NZ | 529705 | A | 6/2004 | |

OTHER PUBLICATIONS

Extended European Search Report for EP Application No. 24159272.4, dated Jul. 15, 2024.

(Continued)

*Primary Examiner* — Zachary T Moore

(74) *Attorney, Agent, or Firm* — ANDRUS INTELLECTUAL PROPERTY LAW, LLP

(57) ABSTRACT

An exercise machine comprising a resistance mechanism, a supporting frame, and a movable member which is movable relative to the supporting frame into and between a rest position and an extended position during performance of an exercise motion by a user. Movement of the movable member towards the extended position is resisted by the resistance mechanism. A stop device stops the movable member in the rest position, the stop device having an engagement member which engages and is able to translate along a stop surface on the supporting frame when the movable member is moved into the rest position.

20 Claims, 15 Drawing Sheets

(56) References Cited

U.S. PATENT DOCUMENTS

| | | | | |
|---|---|---|---|---|
| 10,786,705 | B2 | 9/2020 | Davis et al. | |
| 10,946,240 | B2 * | 3/2021 | Carter | A63B 21/0615 |
| 2002/0193213 | A1 | 12/2002 | Batca | |
| 2008/0064577 | A1 * | 3/2008 | Pederson | A63B 23/0405 482/140 |
| 2013/0090211 | A1 * | 4/2013 | Campanaro | A63B 23/03525 482/4 |
| 2013/0095981 | A1 * | 4/2013 | Chung-Ting | A63B 22/205 482/66 |
| 2017/0106234 | A1 * | 4/2017 | Carter | A63B 21/0628 |

OTHER PUBLICATIONS

Declaration of Prior Art, signed by the inventors on Aug. 23, 2023 and Sep. 6, 2023.

* cited by examiner

EXERCISE MACHINES FOR WEIGHT TRAINING

CROSS-REFERENCE TO RELATED APPLICATION

The present application claims the benefit of and priority to U.S. Provisional Patent Application No. 63/449,353, filed Mar. 2, 2023, which is incorporated herein by reference.

FIELD

The present disclosure relates to exercise equipment, and more particularly to exercise machines for weight training, for example for performing a leg press exercise motion or other type of exercise motion.

BACKGROUND

The following U.S. patents are incorporated herein by reference.

U.S. Pat. No. 5,554,086 discloses a compact attachment for a multi-station exercise machine which couples to a low pull station and therefore utilizes the weight stack or other resistance mechanism of the exercise machine. The attachment is designed for performing leg press and other lower limb exercises. The attachment has a frame on which a pair of foot pads are mounted. A seat for the operator of the attachment is suspended from the frame by a pair of parallel pivoting arms so that the seat remains in a relatively constant attitude throughout the exercise stroke. The invention may be alternatively embodied as a stand-alone device utilizing free weights as a means for providing exercise resistance.

U.S. Pat. No. 7,727,128 discloses a leg press exercise machine that provides translational and rotational motion of the user support structure by translating the user support structure along two intersecting non-orthogonal linear paths. A front portion of the user support structure travels along an inclining linear path and a rear portion of the user support structure travels along a declining linear path. The translation of the user support structure along the inclining and declining linear paths results in the user support structure exhibiting a rotational motion, defining an arcuate path.

U.S. Pat. No. 10,786,705 discloses an exercise machine for leg strengthening, the exercise machine having a stationary frame, and a thigh support member and an ankle support member coupled to the frame and configured to support a user's thigh and ankle, respectively, during a hamstring curl exercise motion. The thigh support member and the ankle support member are each movable with respect to the stationary frame during the hamstring curl exercise motion, thus facilitating contraction and extension of both of a hamstring and glute of the user during the hamstring curl exercise motion.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In non-limiting examples disclosed herein, an exercise machine has a resistance mechanism, a supporting frame, and a movable member which is movable relative to the supporting frame into and between a rest position and an extended position during performance of an exercise motion by a user. Movement of the movable member towards the extended position is resisted by the resistance mechanism. A stop device stops the movable member in the rest position, the stop device having an engagement member which engages and is able to translate along a stop surface on the supporting frame when the movable member is moved into the rest position.

In non-limiting examples disclosed herein, an exercise machine is for performing a leg press exercise motion. The exercise machine comprises a resistance mechanism, a supporting frame, and a seat on which a user can sit during performance of said leg press exercise motion. The seat is movable along a curved path relative to the supporting frame into and between a rest position and an extended position during performance of said leg press exercise motion. Movement of the seat towards the extended position is resisted by the resistance mechanism. A stop device stops the seat when the seat is moved into the rest position, the stop device having an engagement member which engages and is able to translate along a stop surface on the supporting frame.

BRIEF DESCRIPTION OF THE DRAWINGS

The present disclosure includes the following Figures.

DETAILED DESCRIPTION

Figure 7:
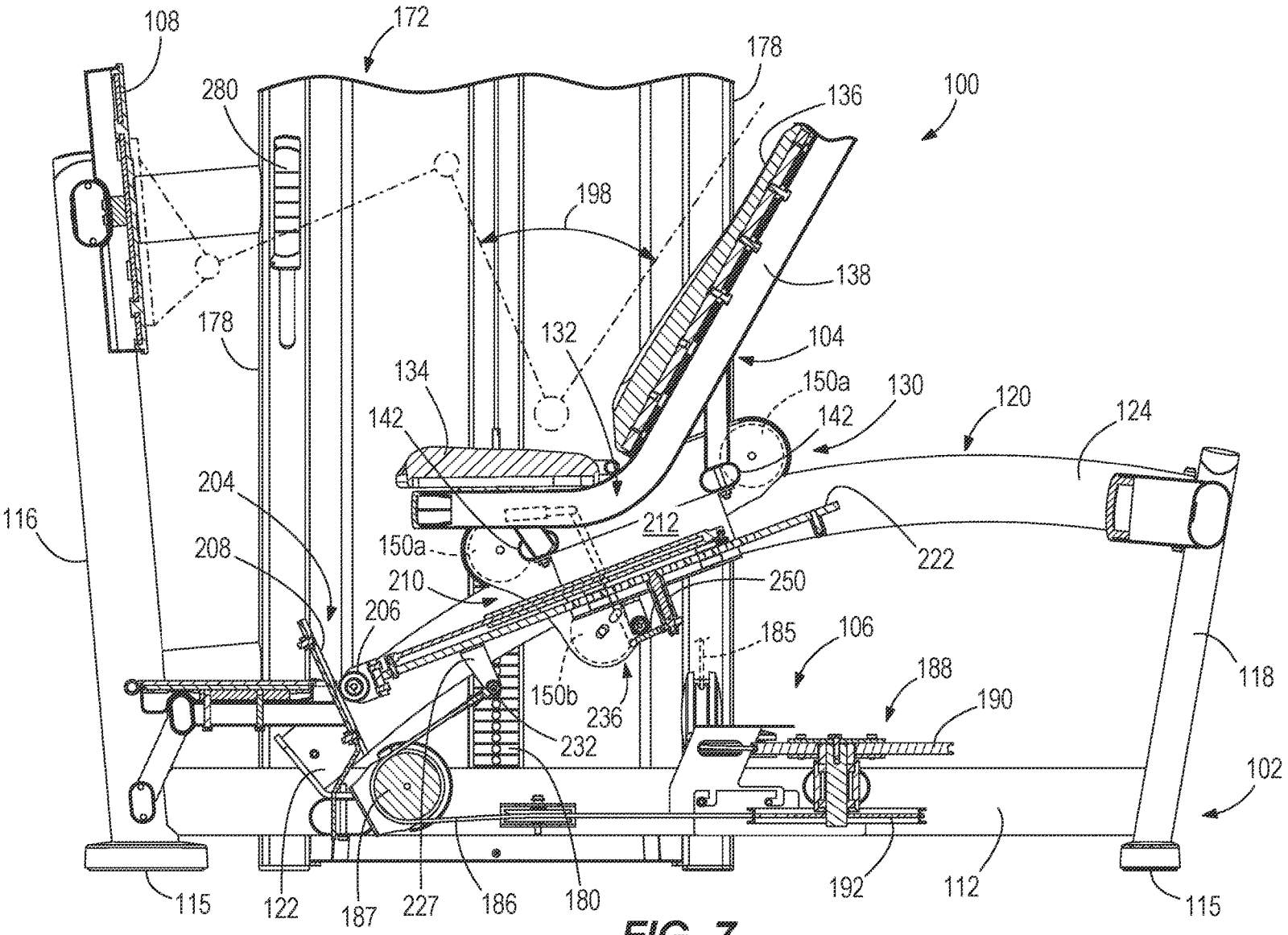
FIG. 7 is a view of section 7-7, taken in FIG. 1, with seat assembly in the rest position.
Figure 8:
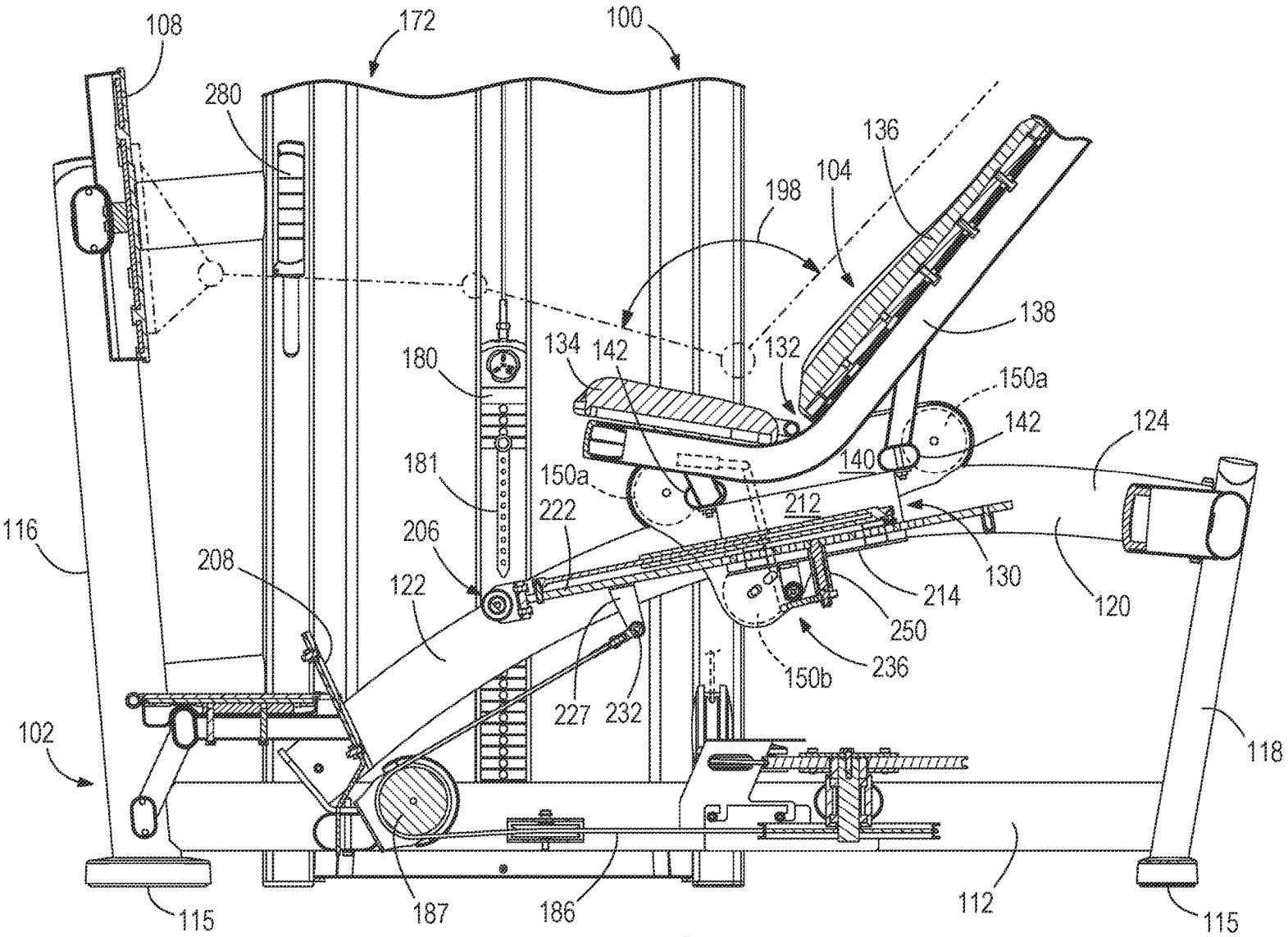
FIG. 8 is a view of section 7-7, taken in FIG. 1, with seat assembly in the extended position.

FIGS. 1-4 illustrate an embodiment of an exercise machine 100. The exercise machine 100 extends from front to back in a longitudinal direction L, from top to bottom in a vertical direction V, and from side to opposite side in a horizontal direction H. The exercise machine 100 includes a supporting frame 102, a seat assembly 104 supported on the supporting frame 102 and movable relative to the supporting frame 102, and a resistance mechanism 106 operatively connected to the seat assembly 104 and configured to resist movement of the seat assembly 104 towards the extended position. In the illustrated embodiments, the exercise machine 100 is configured for performing a leg press exercise motion. A user sitting in a seat 134 of the seat assembly 104 places their feet against a foot plate 108 and extends their legs to move the seat assembly 104 from a rest position (FIG. 7) to an extended position (FIG. 8) against the force of the resistance mechanism 106. However, it should be appreciated that some embodiments of the exercise machine 100 may be configured for performing a different exercise motion.

With continued reference to FIGS. 1-4, the supporting frame 102 includes two longitudinal base members 112 that are spaced horizontally apart from each other. Horizontal base members 114 extend between and connect the longitudinal base members 112. Support feet 115 are positioned at the front and rear corners of the supporting frame 102 and support the supporting frame 102 above the ground. The supporting frame 102 includes two forward support columns 116 that extend vertically upwards from the front ends of the longitudinal base members 112 and support the foot plate 108, which is mounted at the upper ends of the forward support columns 116. Rear support columns 118 extend vertically upwards from the back ends of the longitudinal base members 112, and a horizontal member 119 extends between the upper ends of the rear support columns 118. Two curved rails 120 extend from front ends 122, which are secured to the longitudinal base members 112 proximate the front of the exercise machine 100, to back ends 124 coupled to the rear support columns 118 proximate the upper ends thereof. The curved rails 120 are generally parallel and are configured to support the seat assembly 104, which is secured to the curved rails 120 by carriage 130 that allows the seat assembly 104 to move longitudinally along the curved rails 120.

Figure 5:
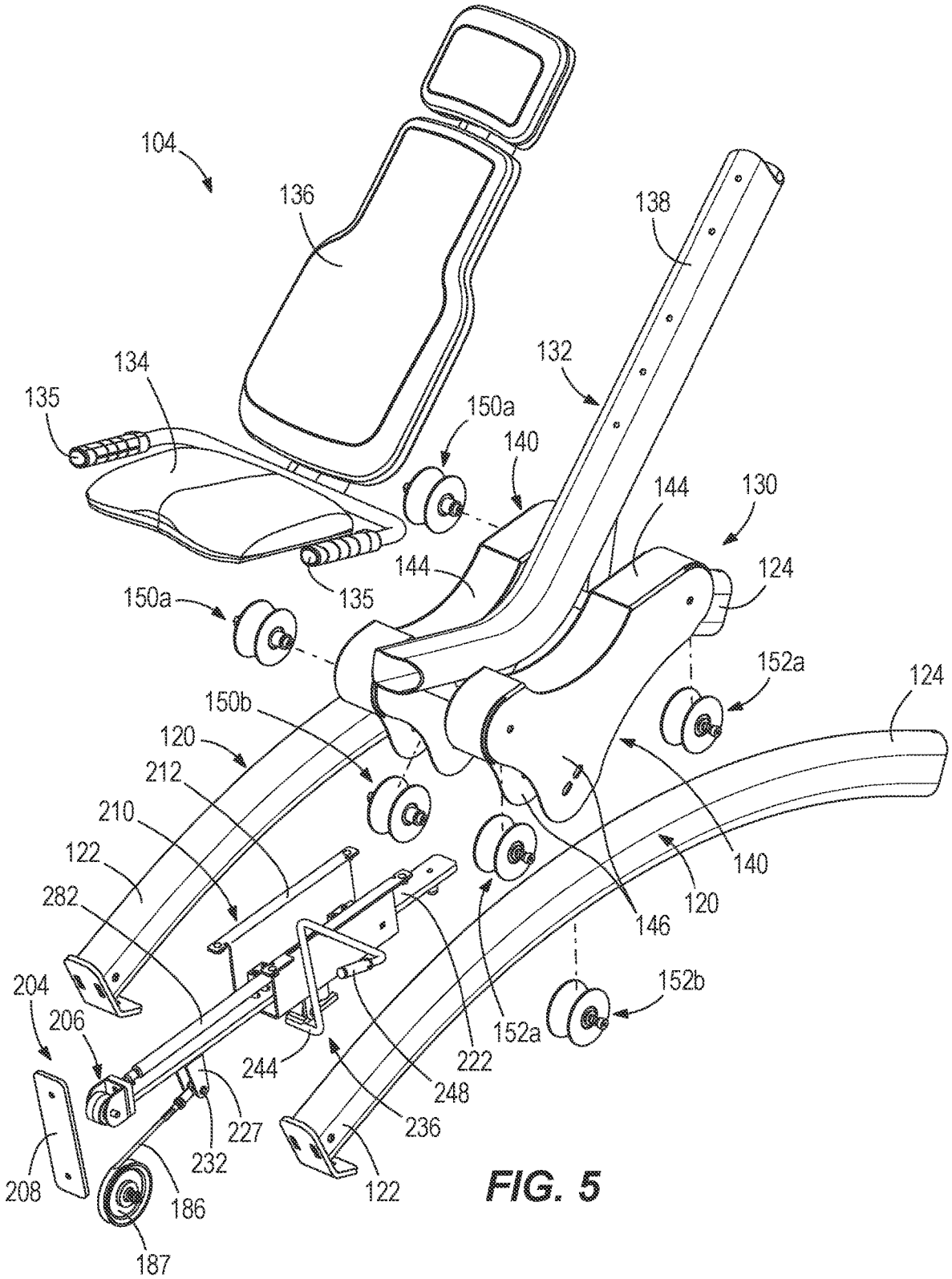
FIG. 5 is an exploded view of the selector mechanism and seat assembly of the exercise machine of FIG. 4.

Referring to FIG. 5, the seat assembly 104 includes a movable member 132 coupled to a carriage 130 configured to roll longitudinally along the two curved rails 120. The movable member 132 includes a seat 134, a backrest 136, and a seat frame 138 that supports the seat 134 and backrest 136 on the carriage 130. The carriage 130 includes two roller brackets 140 that are connected by to horizontal members 142 (see, e.g., FIGS. 9-11) extending between the roller brackets 140. Referring to FIGS. 5 and 13-16, each roller bracket 140 includes a top wall 144 and two opposing lateral walls 146 extending downwardly therefrom. Each roller bracket 140 supports three rollers-two upper roller 150*a*, 152*a* and one lower roller 150*b*, 152*b*—that secure each roller bracket 140 to a corresponding one of the curved rails 120, thereby allowing the carriage 130 to roll longitudinally on the curved rails 120. On each lateral side of the carriage 130, two upper roller 150*a*, 152*a* are configured to roll along a top side of the corresponding curved rail 120 while the lower roller 150*b*, 152*b* rolls along the bottom side of the curved rail 120 to prevent the seat assembly 104 from lifting off the curved rails 120.

In the illustrated embodiments, the two curved rails 120 are generally parallel to each other. However, some embodiments of the illustrated exercises machine 100 may include at least one set of self-aligning rollers 152*a*, 152*b* that are configured to allow the seat assembly 104 to roll along the curved rails 120 even if the curved rails 120 are not perfectly parallel to each other. Referring to FIGS. 13-16, the fixed rollers 150 and self-aligning rollers 152 are coupled to the corresponding roller bracket 140 by a fastener 154 that extends between opposing lateral walls 146 thereof and defines an axis of rotation around which the rollers 150, 152 rotate. Each roller 150, 152 includes a wheel 156 and at least one bearing 158 that allow the wheels 156 to freely rotate about the fastener 154.

Figure 16:
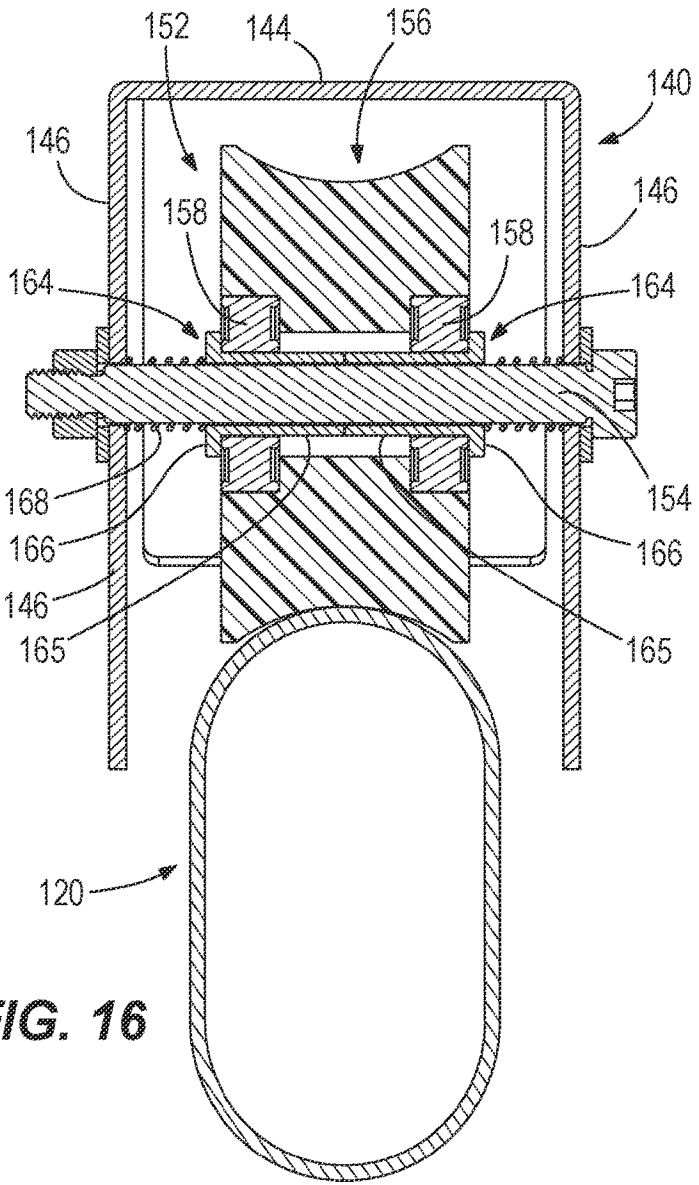
FIG. 16 is a section view illustrating the self-aligning roller assembly of FIG. 14 on the curved rail member of the exercise machine of FIG. 12.
Figure 15:
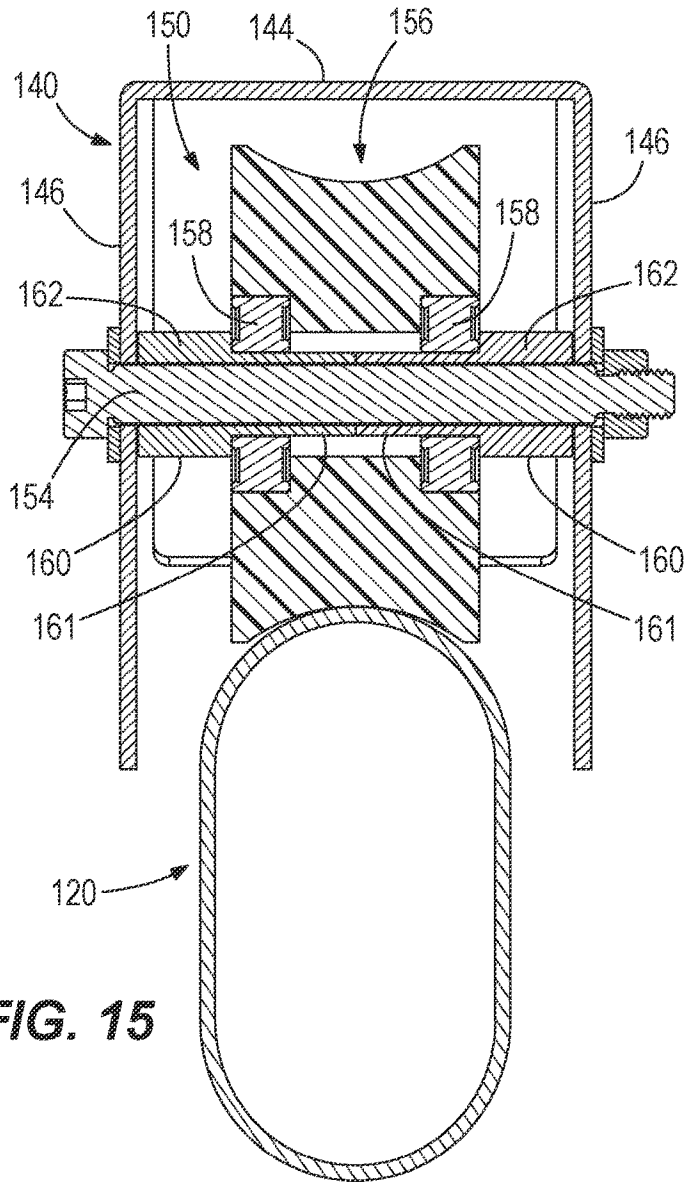
FIG. 15 is a section view illustrating the fixed roller assembly of FIG. 13 on the curved rail member of the exercise machine of FIG. 12

The fixed rollers 150 (FIGS. 13 and 15) each include two bushings 160 having tubular portions 161 that extend into the bearings 158 and relatively thick annular flanges 162 that extend radially outward from the tubular portions 161 on either side of the corresponding wheel 156. The annular flanges 162 of the bushings 160 are configured to center the wheel 156 on the fastener 154 between the opposing lateral walls 146 of the roller bracket 140. The self-aligning rollers 152 (FIGS. 14 and 16) each include two bushings 164 with tubular portions 165 and relatively thin annular flanges 166 that extend radially outward from the tubular portions 165. As best illustrated in FIG. 16, compression springs 168 are received on the fasteners 154 on opposing sides of each wheel 156. The compression springs 168 are configured to bias the wheel 156 towards the lateral midpoint on the fastener 154 while allowing the wheel 156 to drift laterally on the fasteners 154. This may be useful, for example, to allow the carriage 130 to roll smoothly on the curved rails 120 even if they are out of alignment and angled with respect to each other.

Referring back to FIGS. 1-4, the resistance mechanism 106 includes a tower 172 positioned on a lateral side of the supporting frame 102. The tower 172 includes a base member 174, a top beam 176, and two vertical support columns 178 extending between the base member 174 and the top beam 176. A weight stack 180 having a plurality of resistance weights is supported by slide bars (not shown) extending between the base member 174 and the top beam 176. A conventional bayonet 181 (partially shown in FIG. 8) extends into a center hole through the weight stack 180 and is engageable by a selector pin for engaging a particular number of resistance weights with the bayonet 181.

Figure 2:
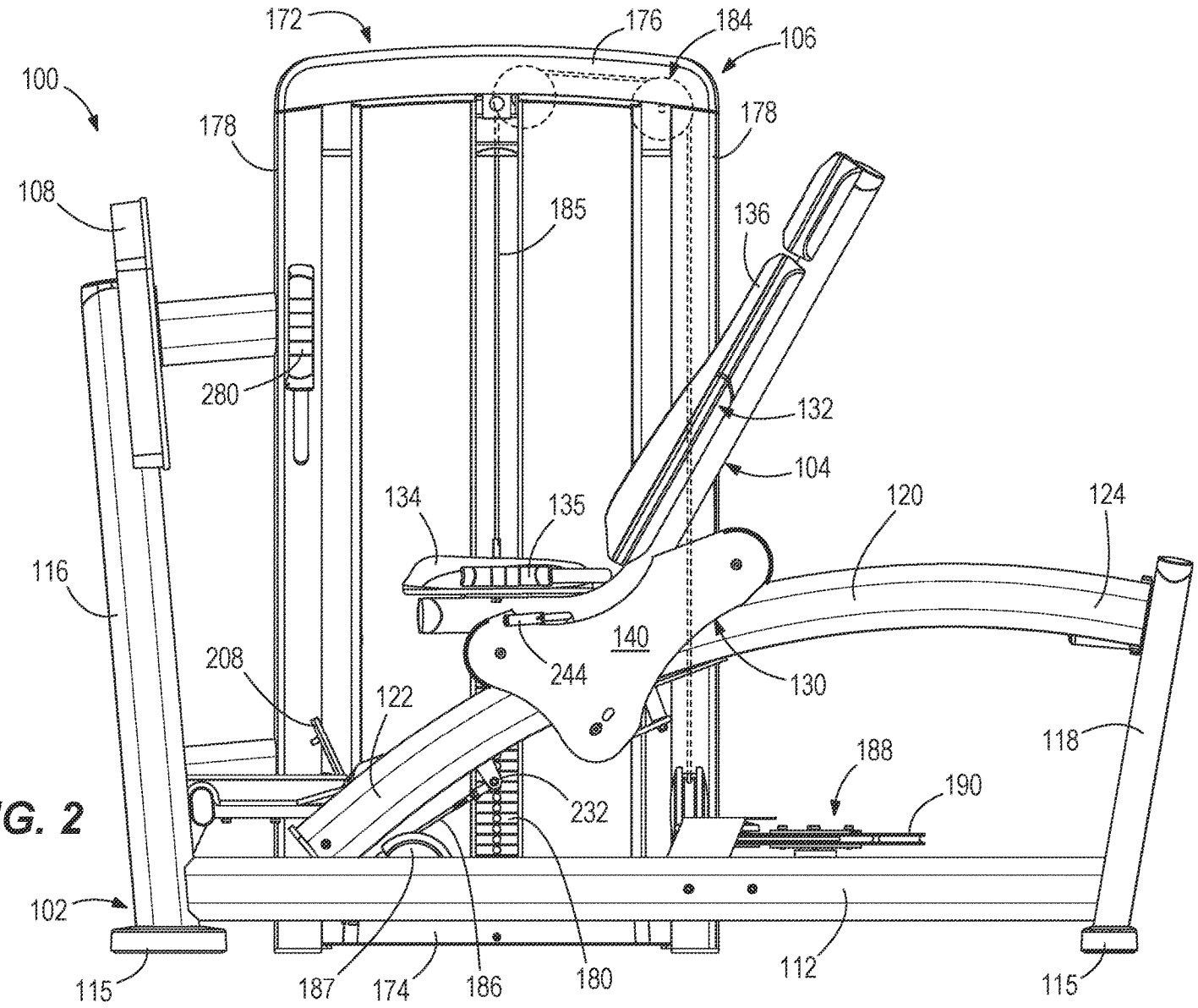
FIG. 2 is a side view of the exercise machine of FIG. 1.
Figure 3:
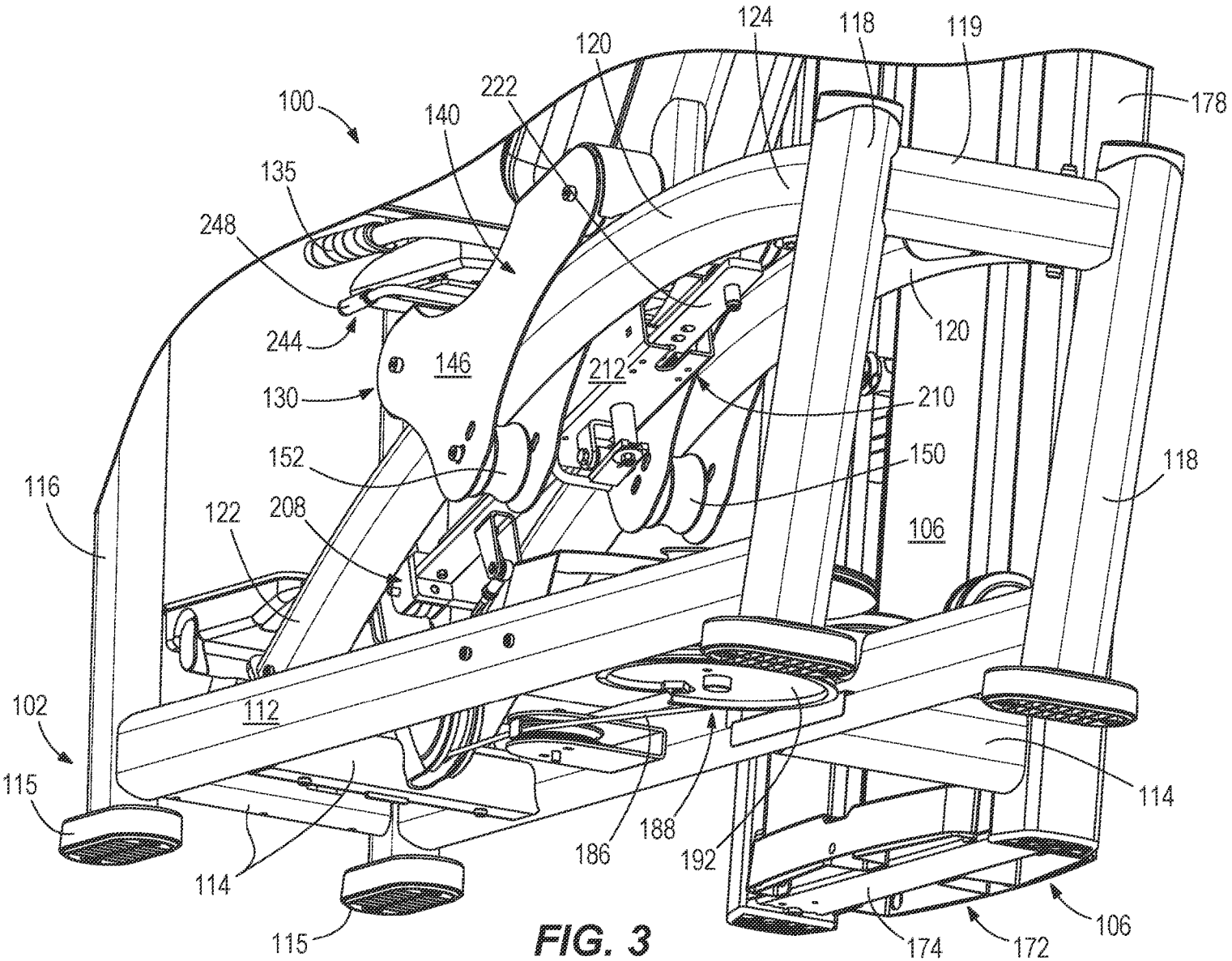
FIG. 3 is a bottom perspective view of the exercise machine of FIG. 2.
Figure 4:
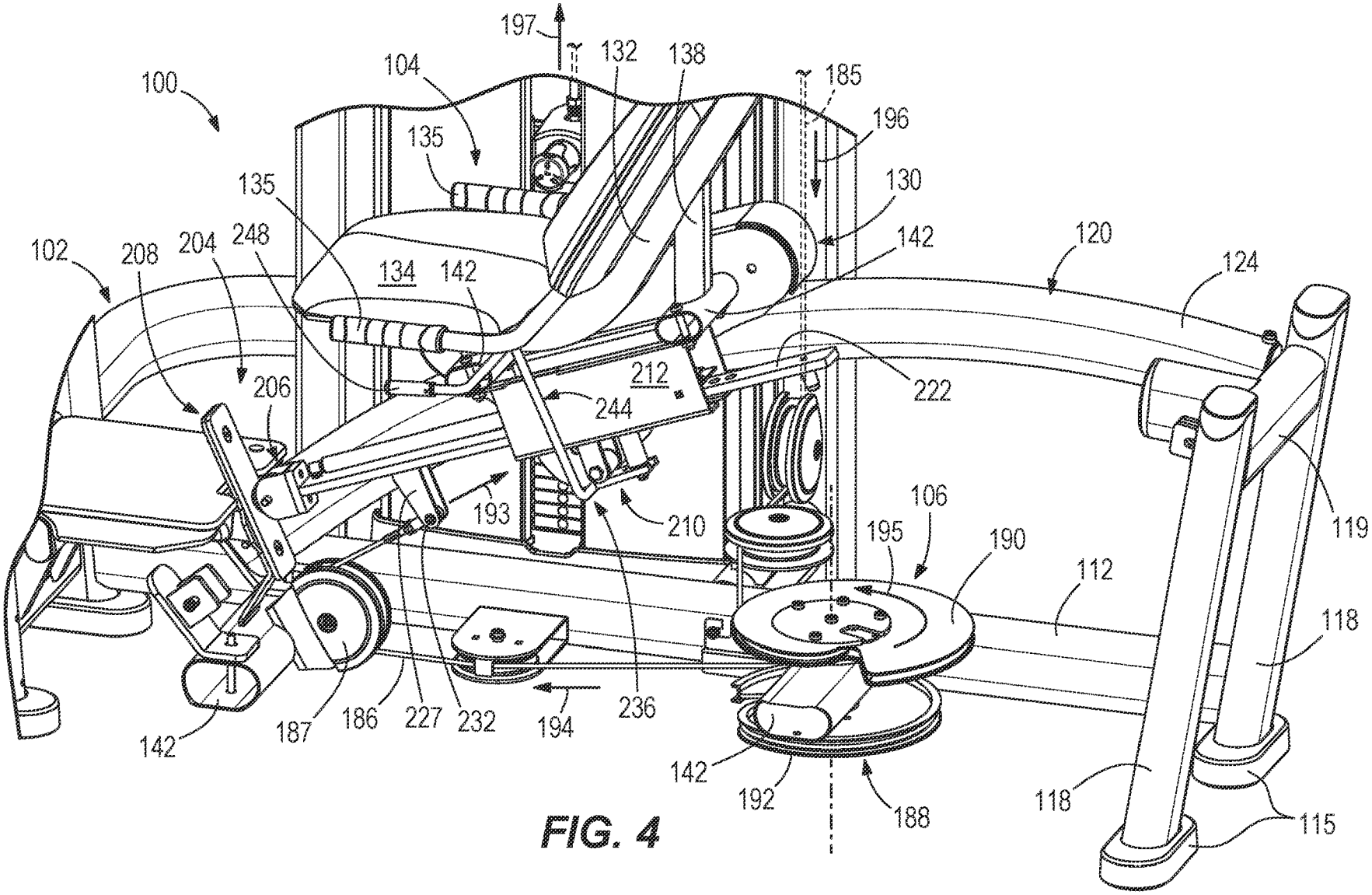
FIG. 4 is a side perspective view of a partial section of the exercise machine of FIG. 3.

The weight stack 180 is operatively coupled to the seat assembly 104 by a pulley system extending between the weight stack 180 and the seat assembly 104. Referring to FIGS. 2 and 4, the pulley system 184 includes two pulley cables 185, 186 and a cam assembly 188. The first pulley cable 185 extends through a plurality of pulley wheels from a first end coupled to the weight stack 180 via the bayonet 181 to a second end coupled to and trained around a first cam 190 of the cam assembly 188. A second pulley cable 186 extends through a plurality of pulley wheels, including a forward pulley wheel 187, between a first end of the second pulley cable 186 coupled to and trained around the second cam 192 and a second end coupled to the seat assembly 104 via the selector mechanism (as will be described in further detail below). The first and second cams 190, 192 are rotatably mounted on the supporting frame 102 and are configured to rotate about a vertical axis of rotation. The first and second cams 190, 192 are also rotationally fixed relative to each other so that rotation of one cam 190, 192 causes the other cam 190, 192 to rotate by the same amount.

In the illustrated embodiments, the first cam 190 and the second cam 192 are differently sized and therefor have different outer profiles around which the pulley cables 185, 186 are configured to be wound. This may be useful, for example, in order to maintain a desired resistance profile over the full range of the intended exercise motion. For example this can provide a ratio of resistance which helps limit inefficiencies of the exercise machine 100 caused by non-linear cable routing relative to loads, connection points, etc., as well as to help maximize resistances offered by the exercise machine 100. Some embodiments may include cams that are differently configured than the illustrated embodiments. For example, some embodiments may be configured with first and second cams that are the same size. Additionally or alternatively, some embodiments may include a pulley system with one pulley cable coupling the movable member 132 of the seat assembly 104 to the weight stack 180 of the resistance mechanism 106. The diameter of the pulley cables 185, 186 may also vary depending upon the amount of resistance offered by the exercise machine 100. The size of other components may also vary from what is shown, for example certain resistance components may be sized larger (e.g., more robust) to accommodate higher resistance and reduce the likelihood of failure. A wide variety of other conventional supporting components may also be added to the exercise machine 100, for example additional or differently configured bearings to facilitate mounting and relative motion of components under resistance load.

In addition to resisting movement of the seat assembly 104, the resistance mechanism 106 additionally biases the seat assembly 104 into the rest position. In the illustrated embodiments, the rest position of the seat assembly 104 is defined by a stop device 204 with an engagement member 206 that engages a stop surface 208 to hold the seat assembly 104 in the rest position. The engagement member 206 includes a stop bracket 256 with a back wall 257 connected to a selector bar 222 of the selector mechanism 210 and two opposing side walls 258 extending forward from opposite lateral sides of the back wall 257. At least one stop roller 260 is rotatably mounted on the stop bracket 256 with a bearing 262 and a fastener 264 that defines an axis of rotation for the stop rollers 260. The stop rollers 260 are configured to abut the stop surface 208 on the supporting frame 102 when the seat assembly 104 is in the rest position. As explained in further detail below, the engagement member 206 is configured to translate along the stop surface 208 when the seat assembly 104 is in the rest position.

Figure 6:
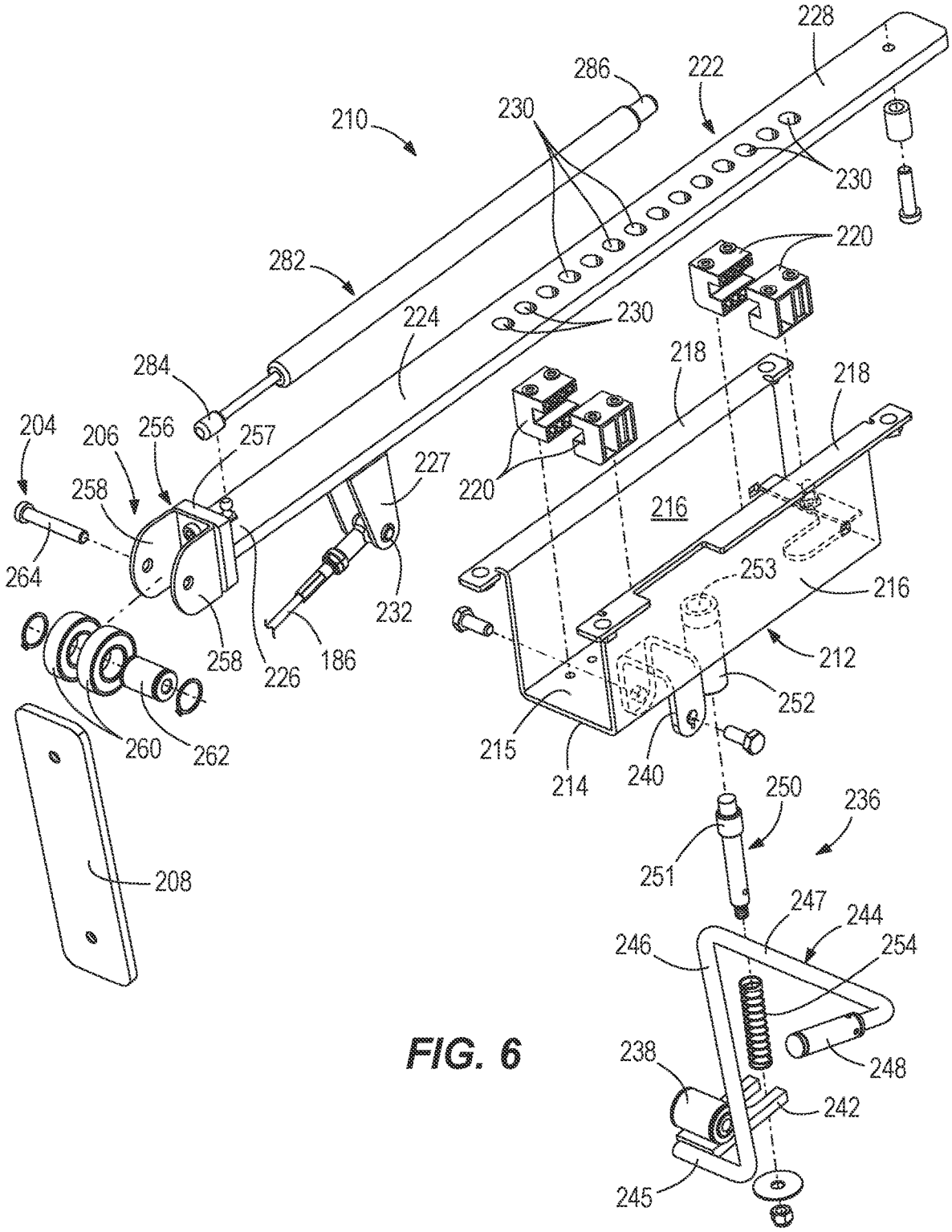
FIG. 6 is an exploded view of the selector mechanism with the stop device and stop surface.

The engagement member 206 of the stop device 204 is coupled to the seat assembly 104 by a selector mechanism 210 which facilitates adjustment of the seat assembly 104 relative to the supporting frame 102 without engaging the resistance mechanism 106, thereby permitting adjustment of a location of the rest position relative to the supporting frame 102. The selector mechanism 210 is mounted to the bottom of the carriage 130 (see, e.g., FIGS. 9-11) by a selector bracket 212. Referring to FIGS. 5 and 6, the selector bracket 212 is generally U-shaped and includes a bottom wall 214 and opposing side walls 216 extending upwardly from opposing lateral sides of the bottom wall 214. Mounting flanges 218 at the top ends of the side walls 216 are configured for securing the selector bracket 212 to the carriage 130 with at least one fastener. Sliding supports 220 are secured to a top surface 215 of the bottom wall 214 and are configured to slidably support a selector bar 222 between the opposing side walls 216 of the selector bracket 212.

The selector bar 222 has a generally planar body 224 that extends from a front end 226 to a back end 228. A cable bracket 227 extends downward from the bottom of the selector bar 222 and is coupled to the second end of the second pulley cable 186 at a cable connection point 232, thereby coupling the selector bar 222 to the resistance mechanism 106. The engagement member 206 of the stop device 204 is mounted at the front end 226 of the selector bar 222 and is configured to engage the stop surface 208 in the rest position. A plurality of selector holes 230, each corresponding to a possible rest position, are formed through the body 224 along the length of the selector bar 222. The body 224 of the selector bar 222 is received by the sliding supports 220 such that the selector bar 222 and the selector bracket 212 can slide longitudinally relative to each other.

Referring to FIGS. 6 and 9-11, the selector mechanism 210 includes a selector actuator assembly 236 configured to actuate a selector pin 250 that engages one of the selector holes 230 of the selector bar 222 in order to link the resistance mechanism 106 to the seat assembly 104 and set the location of the rest position. The selector actuator assembly 236 includes a selector bearing 238 that is pivotably supported by a pivot bracket 240 having two arms that extend downward on the bottom side of selector bracket 212. The selector bearing 238 is connected to an actuator plate 242 and a selector arm 244 that may be actuated by a user to adjust the rest position of the seat 134. The selector arm 244 includes a first horizontal segment 245 that may be coupled to the selector bearing 238 and/or the actuator plate 242, a vertical segment 246 that extends upwardly from the first horizontal segment 245, a second horizontal segment 247 extending laterally from a top end of the vertical segment 246, and a handle 248 coupled to the second horizontal segment 247. As illustrated in FIGS. 2 and 4, the handle 248 of the selector arm 244 is located proximate one of the seat handles 135 that are rigidly connected to the movable member 132. This may be useful, for example, so that the handle 248 can be easily reached and actuated by the user while seated on the exercise machine 100.

Referring to FIGS. 6 and 9-11, the actuator plate 242 is configured to move a spring-loaded selector pin 250 between a locked position (FIGS. 10-11) in which the seat assembly 104 is locked in a particular rest position and an unlocked position (FIG. 9) in which the seat assembly 104 can move between different rest positions. The selector pin 250 is slidably received in a pin cylinder 252 formed on the bottom side of the bottom wall 214 of the selector bracket 212. A through bore 253 is formed through the bottom wall 214 at the top of the pin cylinder 252 so that a top end of the selector pin 250 may extend up through the bottom wall 214 to engage one of the selector holes 230 in the selector bar 222. An annular rim 251 formed around the selector pin 250 prevents the selector pin 250 from passing through the through bore 253. A spring 254 is positioned on the selector pin 250 between an annular rim 251 and the actuator plate 242. The spring 254 is configured to push the selector pin 250 upwards into the locked position in which the selector pin 250 is engaged with the selector bar 222. While the selector pin 250 is in the locked position, the seat assembly 104 is rigidly coupled to resistance mechanism 106 via the selector bar 222 such that movement of the seat assembly 104 towards the extended position is resisted by the resistance mechanism 106.

Figure 9:
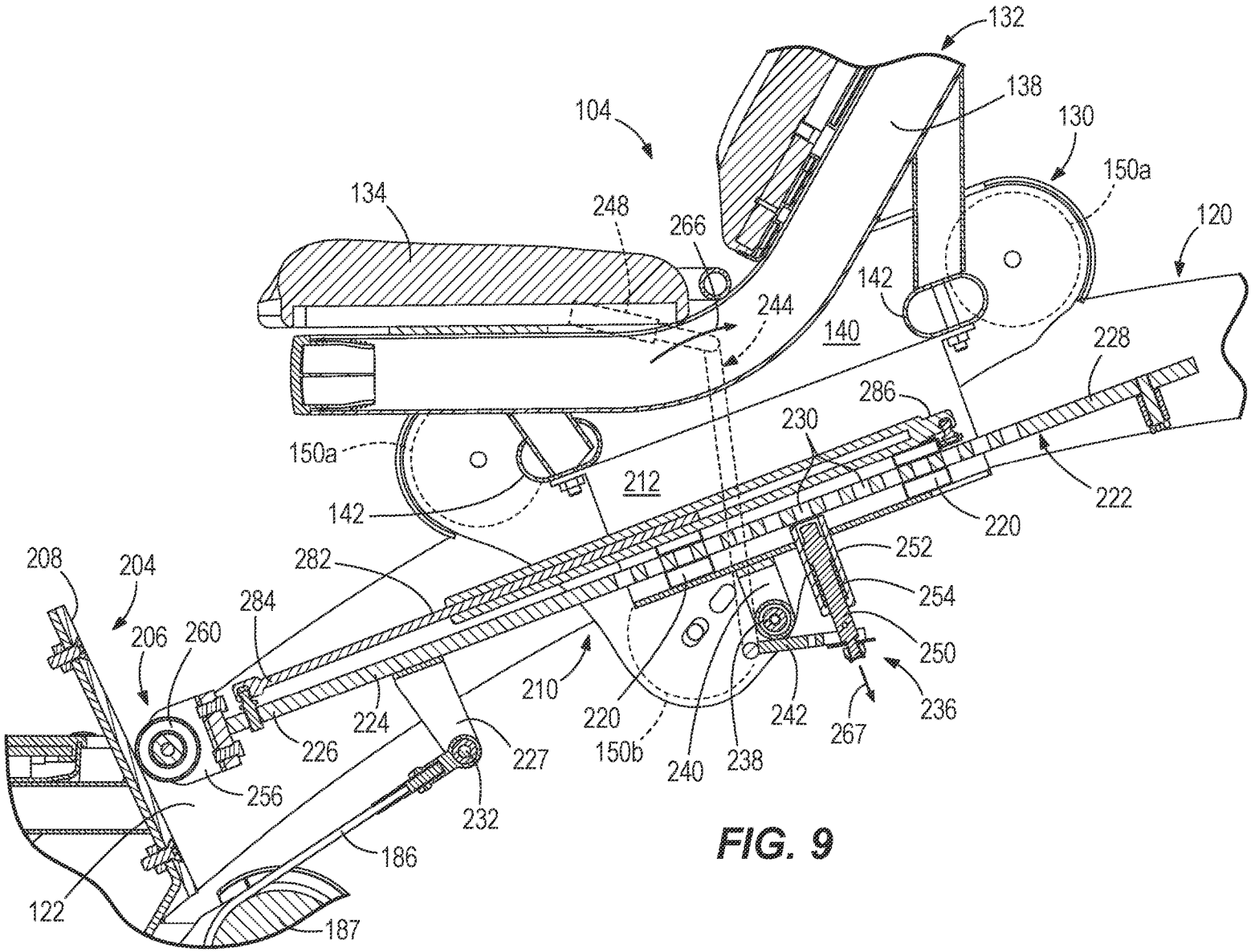
FIG. 9 is a detailed view of section 7-7, taken in FIG. 1, with the selector mechanism in the unlocked position and the seat assembly in a first position.
Figure 10:
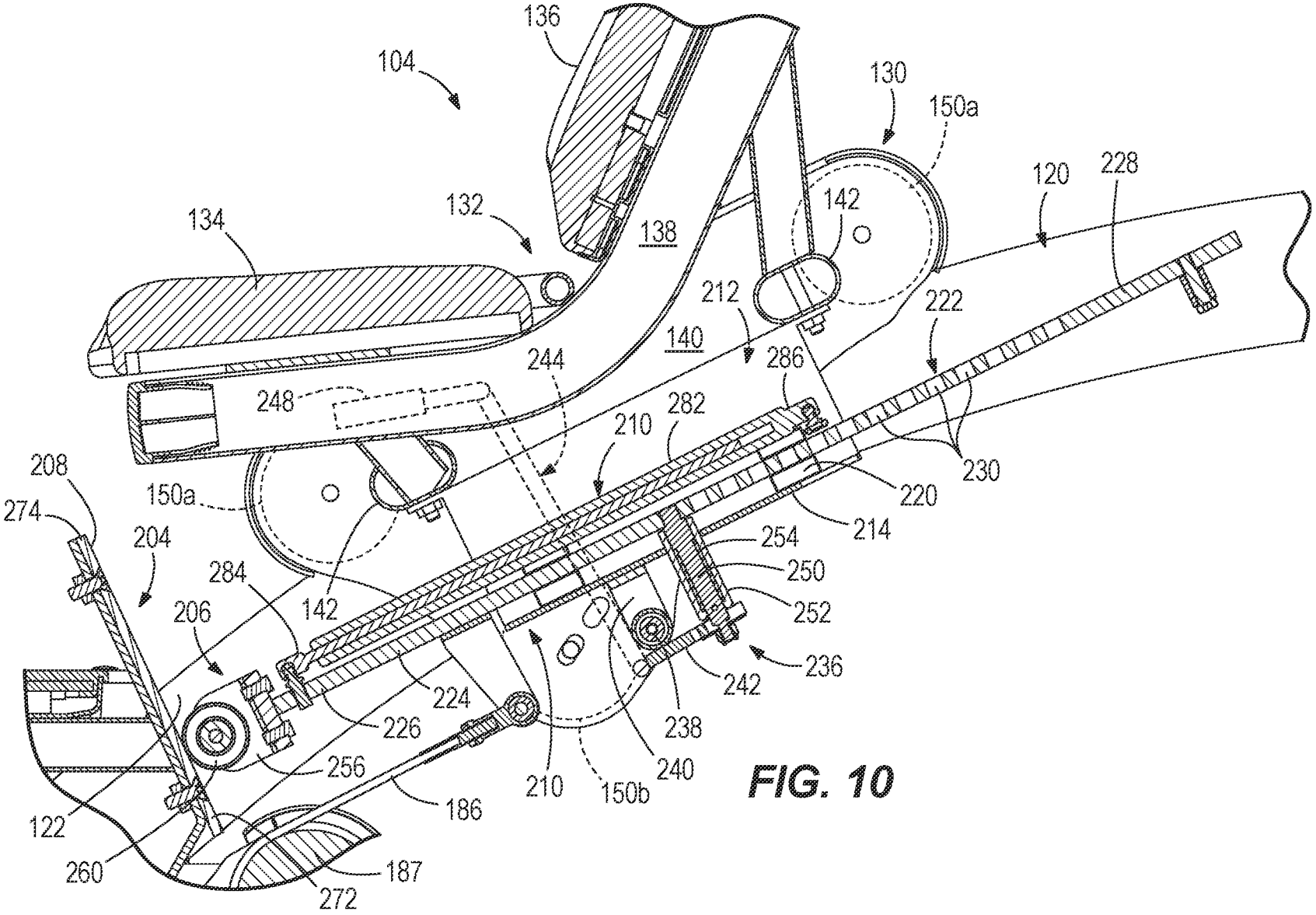
FIG. 10 is a detailed view of section 7-7, taken in FIG. 1, with the selector mechanism in the locked position and the seat assembly in a second position.
Figure 11:
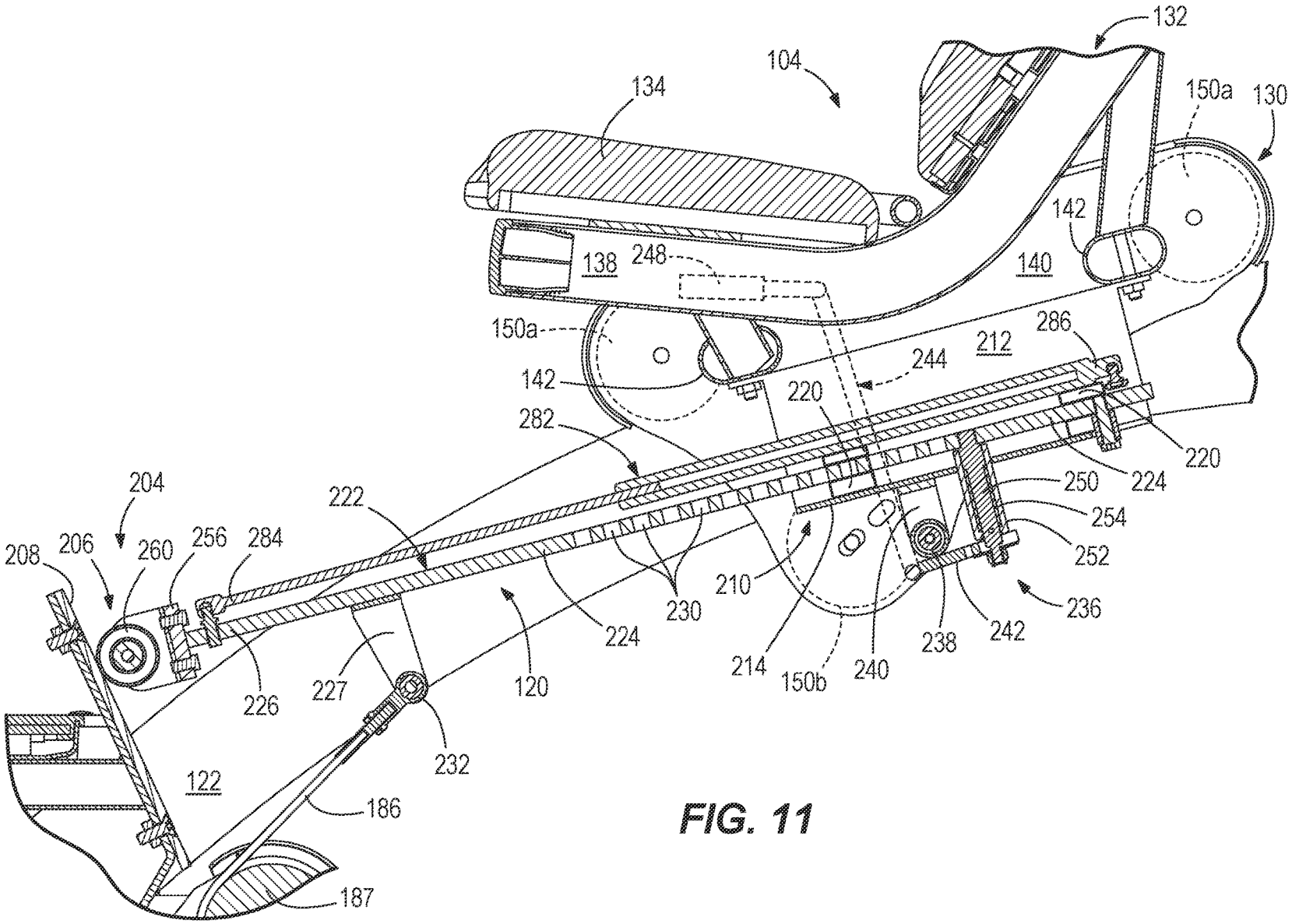
FIG. 11 is a detailed view of section 7-7, taken in FIG. 1, with the selector mechanism in the locked position and the seat assembly in a third position.

Referring to FIGS. 9-11, a user can adjust the resting position of the movable member 132 relative to the supporting frame 102 by actuating the selector mechanism 210 while the seat assembly 104 is in the rest position. To move the selector pin 250 into the unlocked position, the selector handle 248 can be pulled to pivot the selector arm 244 about the pivot axis defined by the selector bearing 238 in the direction of arrow 266 in FIG. 9. As the selector arm 244 pivots, the actuator plate 242 coupled to the selector bearing 238 and/or the first horizontal segment 245 pivots with the selector arm 244 and pulls the selector pin 250 downwards in the direction of arrow 267, and thereby disengaging the selector pin 250 from the selector bar 222 and moving the selector pin 250 into the unlocked position, as illustrated in FIG. 9.

While the selector pin 250 is held in the unlocked position by the selector arm 244 and actuator plate 242, the seat assembly 104 is disconnected from the selector bar 222 and can be freely moved by the user extending or retracting his or her legs so that the seat assembly 104 is moved along the curved rails 120 without engaging the resistance mechanism 106. The selector bar 222 is held in place by the resistance mechanism 106, which holds the engagement member 206 in abutment with the stop surface 208. As the seat assembly 104 and carriage 130 move along the curved rails 120, the selector bar 222 maintains its longitudinal position and slides in the sliding supports 220 while the seat assembly 104 is moved forwards or backwards relative to the supporting frame 102. Once the desired rest position is reached, the selector arm 244 is released and the selector pin spring 254 biases the selector pin 250 upwards and back into engagement with one of the selector holes 230 in the selector bar 222. For example, in FIG. 10 the seat assembly 104 is in a first rest position in which the seat assembly 104 is positioned proximate the front ends 122 of the curved rails 120. In FIG. 11, the seat assembly 104 is in a second rest position in which the seat assembly 104 is positioned proximate the back ends 124 of the curved rails 120. The illustrated exercise machine 100 includes a selector bar 222 with fourteen selector holes 230 and therefor fourteen possible resting positions. Some embodiments, however, may be configured with a different number of selector holes and corresponding rest positions.

As the rest position of the seat assembly 104 is adjusted, the carriage 130 and the seat assembly 104 roll on the rollers 150, 152 along the two curved rails 120. Because the curved rails 120 are curved, the angle of the movable member 132 relative to the ground changes based on the location of the carriage 130 on the curved rails 120. While the carriage 130 can move in the longitudinal direction relative to the stationary selector bar 222, the angular position of selector bar 222 relative to the seat assembly 104 is constrained by the sliding supports 220, which do not permit the selector bar 222 to rotate relative to the seat assembly 104. Thus, the selector bar 222 rotates with the seat assembly 104 as the resting position is adjusted and the engagement member 206 of the stop device 204 translates across the stop surface 208.

As the seat assembly 104 is moved forward along the curved rails 120 towards the forwardmost possible resting position, the seat 134 and the selector mechanism 210 (including the selector bar 222) tilt forward as the top surface of the curved rails 120 turns downward. As the selector bar 222 tilts downward, the engagement member 206 translates downward on the stop surface 208. For example, the illustrated stop rollers 260 of the engagement member 206 roll downward along the stop surface 208 to a bottom end 272 thereof. As the seat assembly 104 is moved backwards along the curved rails 120 towards the rear resting position, the seat assembly 104 and the selector bar 222 tilt backwards and the engagement member 206 translates upward on the stop surface 208. In the illustrated embodiments, for example, the stop rollers 260 of the engagement member 206 roll upward along the stop surface 208 to a top end 274 thereof.

Figure 12:
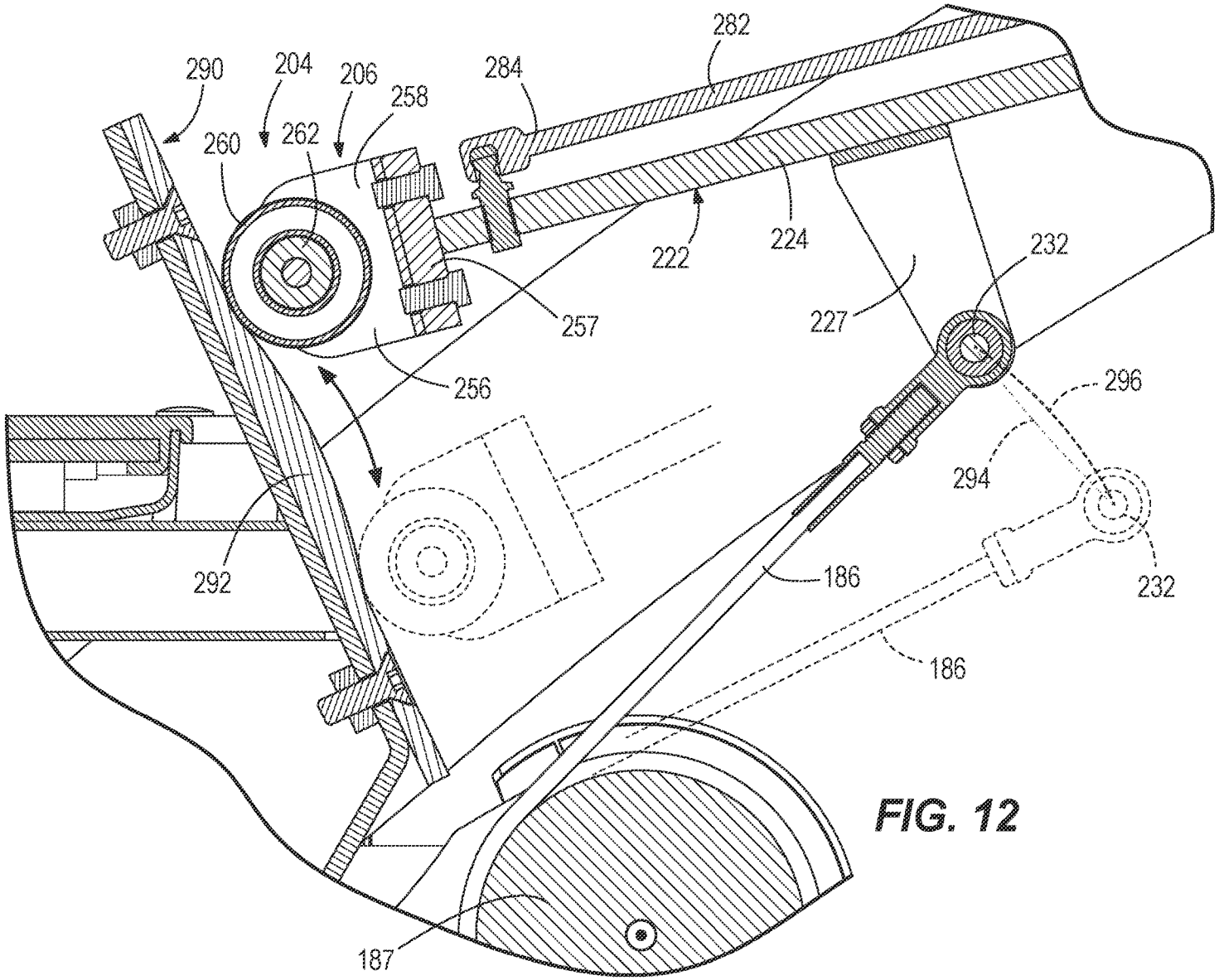
FIG. 12 is a detailed view of section 7-7, taken in FIG. 1, illustrating translation of the stop device across a convex stop surface.
Figure 13:
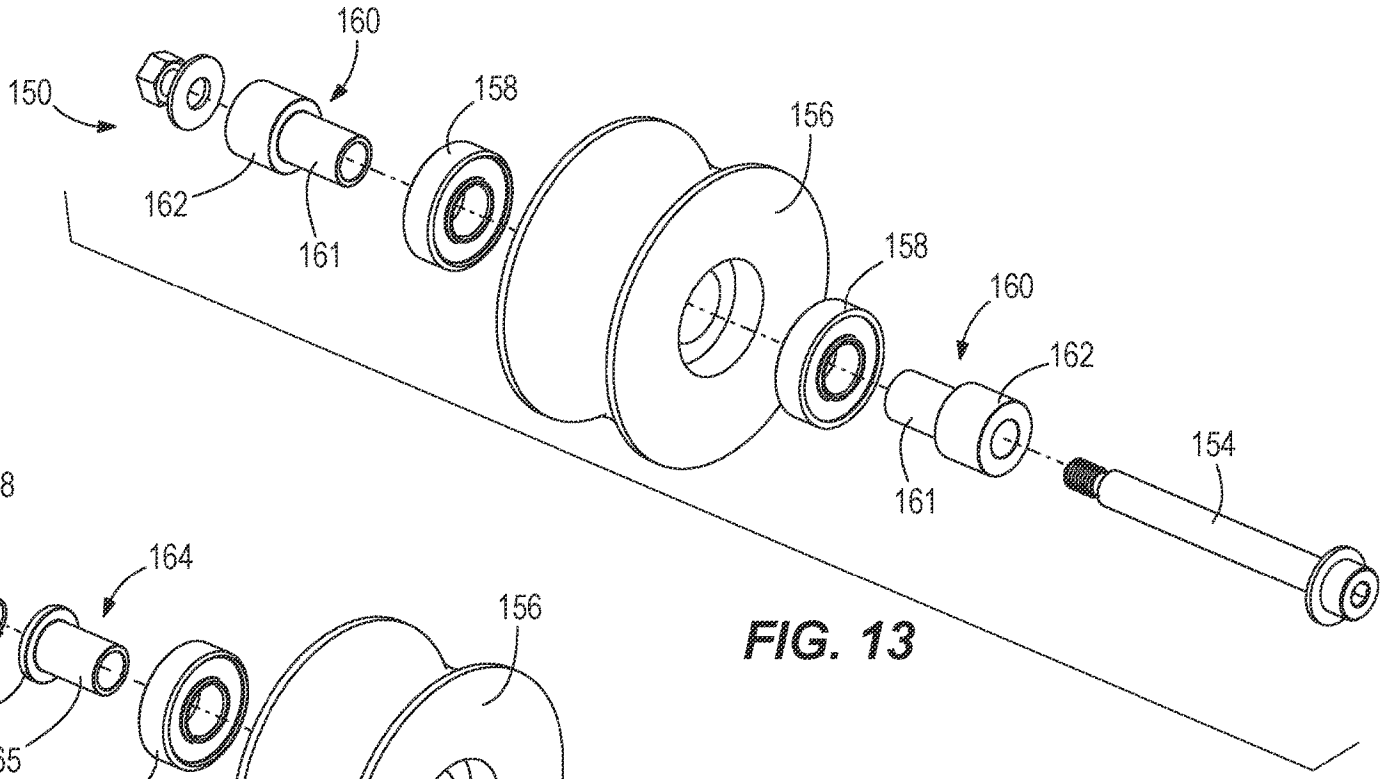
FIG. 13 is an exploded view of a fixed roller assembly of the exercise machine of FIG. 12.
Figure 14:
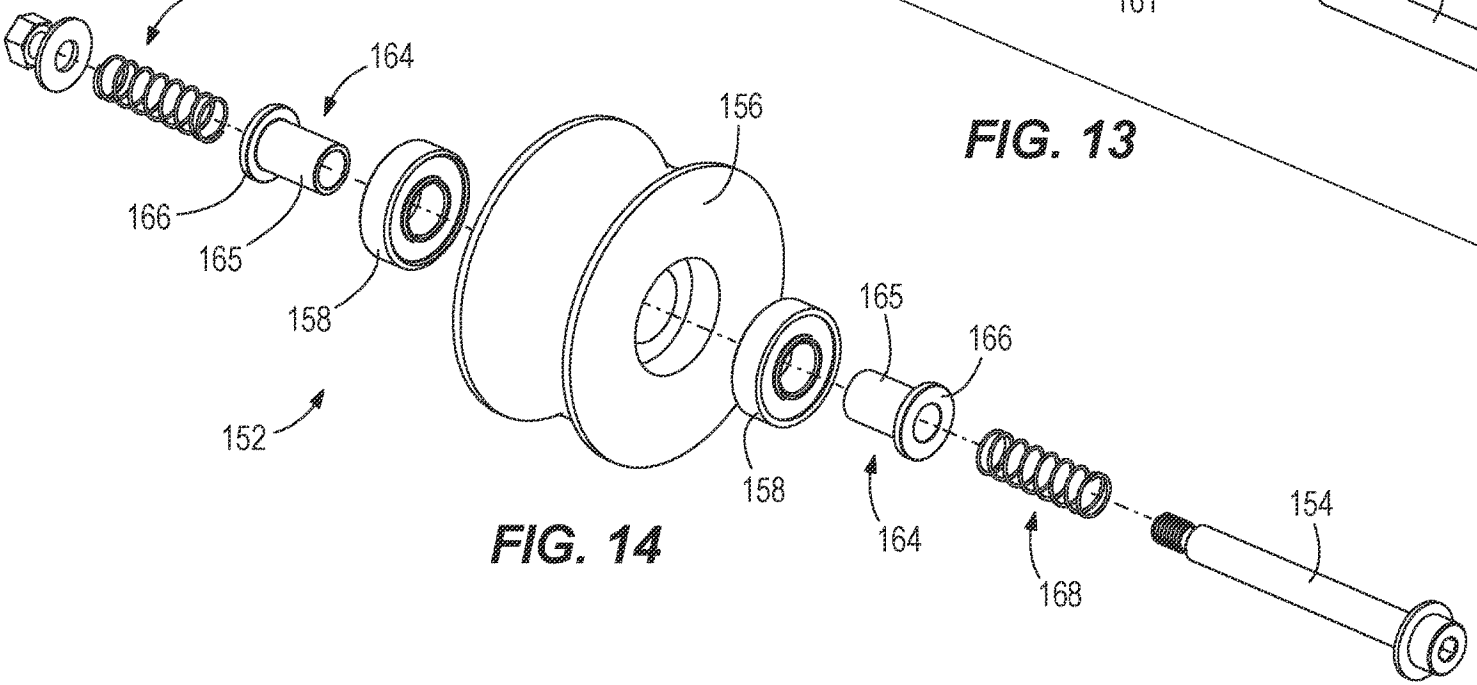
FIG. 14 is an exploded view of a self-aligning roller assembly of the exercise machine of FIG. 12.

As the angle of the selector bar 222 changes when the rest position of the seat assembly 104 is adjusted, the cable bracket 227 that couples the second pulley cable 186 to the selector bar 222 is both rotated and translated, thereby moving the cable connection point 232 between the second pulley cable 186 and the cable bracket 227. As the cable bracket 227 moves, the distance between the cable connection point 232 and the forward pulley wheel 187 changes causing a corresponding change in the tension in the second pulley cable 186. In embodiments with a planar stop surface 208, the cable connection point 232 follows a generally straight path 294 (see FIG. 12) such that the cable connection point 232 is closest to the forward pulley wheel 187 when the engagement member 206 is near the center of the stop surface 208. Thus, tension of the second pulley cable 186 will be highest when the engagement member 206 has rolled towards the top or the bottom of the stop surface 208 and tension in the second pulley cable 186 will be lowest when the engagement member 206 is proximate the center of the stop surface 208.

In order to maintain constant tension in the pulley cables 185, 186, some embodiments of an exercise machine 100 may be configured with a curved stop surface. For example, referring to FIG. 12, the exercise machine 100 of FIGS. 1-11 may be configured with a convex stop surface 290. The convex stop surface 290 has generally planar sections proximate the top and bottom ends thereof and includes a raised portion 292 proximate the center of the convex stop surface 290. In the illustrated embodiment, the curvature of the convex stop surface 290 has been selected so that the cable connection point 232 follows a curved path 296 that matches the involute of second end of the second pulley cable 186 as it is wound and/or unwound from the forward pulley wheel 187. Thus, as the engagement member 206 rolls across the curved stop surface 290, the distance between the cable connection point 232 and the forward pulley wheel 187 remains constant, thereby maintaining consistent tension in the second pulley cable 186. This may be useful, for example, so that the resistance mechanism 106 consistently provides consistent resistance according to the desired resistance profile as the user performs exercise motions.

Figure 1:
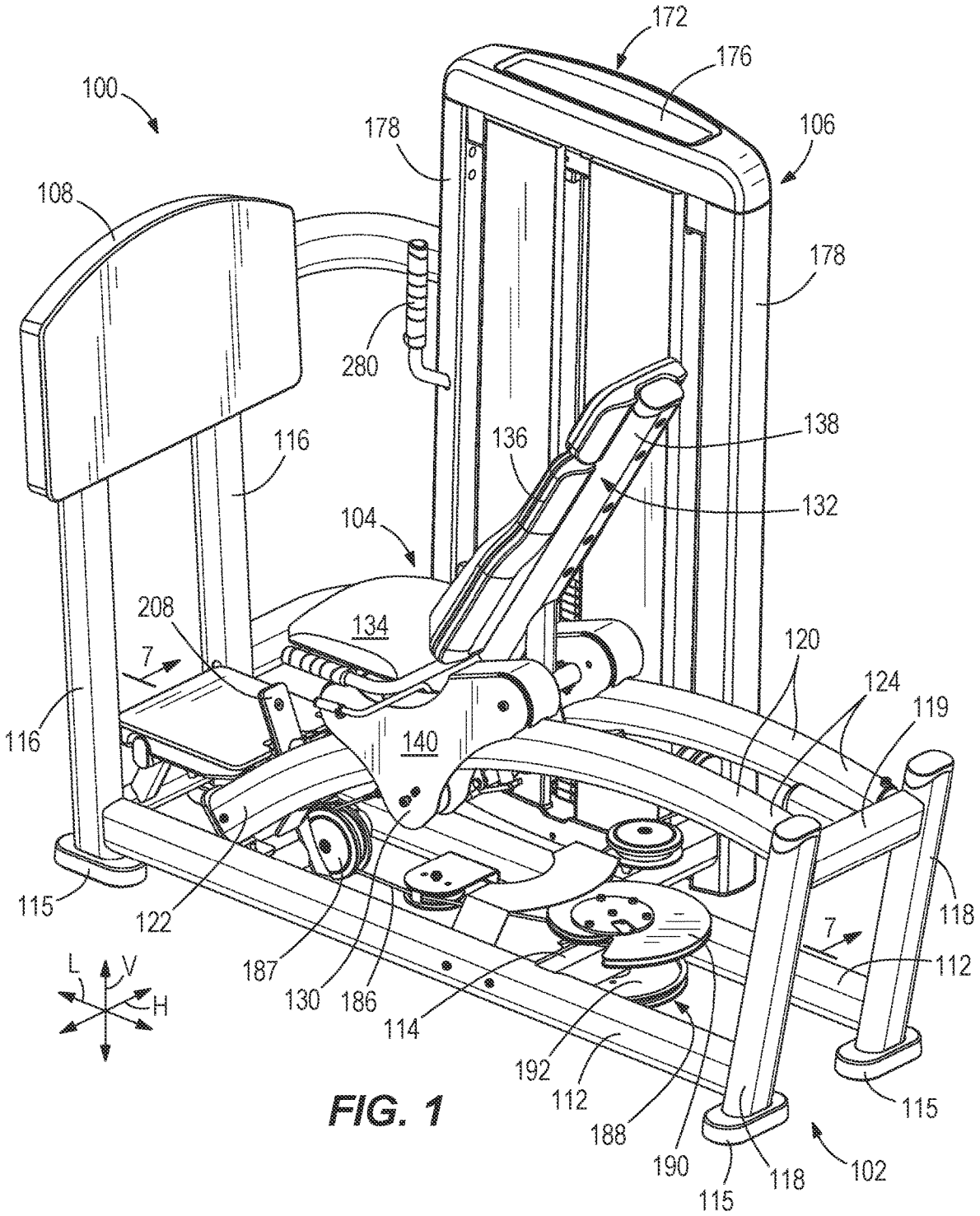
FIG. 1 is a side perspective view of a first non-limiting example of an exercise machine according to the present disclosure.

In some embodiments, an exercise machine 100 may be configured with features to assist a user when adjusting the rest position of the seat assembly 104. For example, as illustrated in FIGS. 1 and 2, some embodiments of an exercise machine 100 may include an adjustment assistance handle 280 that can be held by the user and used for leverage when adjusting the resting position of the seat assembly 104. In the illustrated embodiments, the exercise machine 100 includes an adjustment assistance handle 280 coupled to a support column 178 of the tower 172. A user may grasp the adjustment assistance handle 280 to assist in adjusting the rest position while sitting in the seat 134. Some embodiments may include at least one handle at a different location on the supporting frame 102.

Additionally or alternatively, an embodiment of an exercise machine 100 may be configured with an assist mechanism to aid the user in moving the seat assembly 104 while adjusting the resting position. For example, referring to FIGS. 9-11, the illustrated exercise machine 100 includes gas-spring assist mechanism 282. The gas-spring assist mechanism 282 has a first end 284 connected to the selector bar 222 proximate the front end 226 thereof and a second end 286 coupled to the selector bracket 212. When the selector pin 250 is moved into the unlocked position so that the carriage 130 and seat assembly 104 can move freely, the gas-spring assist mechanism 282 is configured to support a portion of the weight of the seat assembly 104 and carriage 130, thereby reducing the force a user must apply to move the seat assembly 104 and carriage 130 between different resting positions.

Once a user has adjusted the seat assembly 104 to the desired position, exercise motions may be performed on the exercise machine 100. As previously mentioned, a user can perform a leg press exercise motion on the exercise machine 100 by placing their feet against a foot plate 108 and extending their legs to move the seat assembly 104 from a rest position (FIG. 7) to an extended position (FIG. 8) against the force of the resistance mechanism 106. Referring to FIGS. 2 and 4, as the user extends their legs, the seat assembly 104 rolls along the curved rails 120 towards the extended position and the second pulley cable 186 is pulled through the corresponding pulley wheels in the direction of arrow 193 and arrow 194. As the second pulley cable 186 is pulled, it is unwound from the second cam 192, causing the cams 190, 192 to rotate in the counterclockwise direction indicated by arrow 195. As the first cam 190 rotates in the counterclockwise direction, the first pulley cable 185 is drawn towards and wraps around the first cam 190 as the first pulley cable 185 is pulled in the direction of arrow 196 and arrow 197, thereby lifting the weight stack 180 against the force of gravity to resist movement of the seat assembly 104.

As the seat assembly 104 moves from the rest position (FIG. 7) towards the extended position (FIG. 8), the seat assembly rolls along the curved rails 120. Advantageously, the self-aligning rollers 152 allow the seat assembly 104 to translate smoothly along the curved rails 120 even when the curved rails 120 are slightly out of alignment. As the carriage 130 continues to move along the curved rails 120, the angle of the seat 134 relative to the floor changes as the seat assembly 104 tilts back as the carriage 130 follows the curvature of the curved rails 120. When the carriage 130 is positioned towards the front ends 122 of the curved rails 120, the carriage 130 is supported on the curved rails 120 by the upper rollers 150*a*, 152*a*. However, as the carriage 130 moves towards the back ends 124 of the curved rails 120, the center of gravity of the carriage 130 and any user sitting in the seat 134 shifts rearwards, adjusting the balance of the carriage 130. In particular, an increasing portion of the weight of the seat assembly 104 and a user situated thereon shifts from the front upper rollers 150*a*, 152*a* onto the upper rollers 150*a*, 152*a* at the back end of the carriage 130. The shift in the center of gravity towards the back of the carriage 130 as the carriage 130 moves backwards may cause the seat assembly 104 to tip backwards, thereby lifting the front upper rollers 150*a*, 152*a* from the curved rails 120. As the seat assembly 104 tilts backwards the lower rollers 150*b*, 152*b* move upwards and into engagement with the bottom surfaces of the curved rails 120, thereby preventing further backwards rotation of the seat assembly 104 and retaining the carriage 130 and seat assembly 104 on the curved rails 120.

The backwards tilting motion of the seat 134 allows a user to more fully extend their legs and hips to move through a greater range of range of femur-to-spine angles 198 as compared to an exercise machine configured with straight rails. For example, in some embodiments, a user perfuming a leg press exercise motion using the exercise machine 100 may have their femur-to-spine angle 198 vary through a range between 50 degrees in the rest position to 109 degrees in the extended position. Some embodiments, however, may permit a different range of femur-to-spine angles 198. For example, some embodiments may be configured to with a minimum resting femur-to-spine angle 198 that is less than 50 degrees or greater than 50 degrees. Some embodiments may be configured to with a maximum extended femur-to-spine angle 198 that is greater than or equal to 109 degrees or less than or equal to 109 degrees. For example, embodiments of an exercise machine 100 may be configured to so that a user's femur-to-spine angle 198 moves through a range of 70 degrees or more. For example, an exercise machine 100 may be configured with a minimum femur-to-spine angle 198 of 45 degrees when in the rest position and a maximum femur-to-spine angle 198 of 115 degrees when in the extended position.

Figure 17:
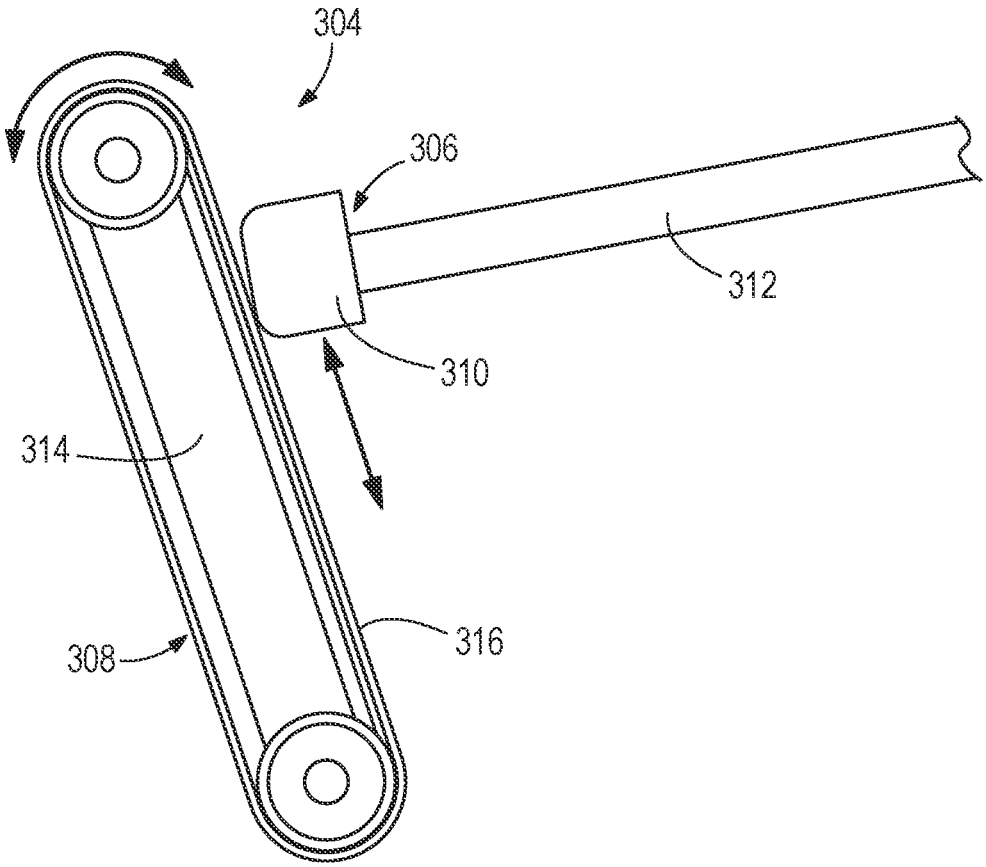
FIG. 17 illustrates another embodiment of a stop device and stop surface configured for use with an exercise machine.

In the embodiments of FIGS. 1-12, the stop device 204 includes a moving engagement member 206 that rolls along a stationary stop surface 208, 290. Some embodiments, however, may be configured with a moving stop surface and a generally stationary engagement member. For example, FIG. 17 illustrates an embodiment of a stop device 304 including an engagement member 306 and a moving stop surface 308. In the illustrated embodiment, the engagement member 306 is configured as a bumper 310 secured to the end of an engagement member rod 312. The stop surface 308 is configured as a conveyor mechanism 314 that is coupled to the supporting frame 102 and includes a conveyor surface 316 that is engaged by the bumper 310. In some embodiments, the conveyor mechanism 314 may be a powered conveyor system that is driven to move the conveyor surface 316 in order to translate the bumper 310 up or down on the conveyor mechanism 314 based on the movement of the engagement member 306 resulting from an adjustment to the seat assembly 104 rest position. Some embodiments, however, may be configured with an unpowered conveyor mechanism 314. In such an embodiment, frictional engagement between the bumper 310 and the conveyor surface 316 may cause the bumper 310 to drag the conveyor surface 316 with the bumper 310 as it rotates and translates when the rest position of the seat assembly 104 is adjusted.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. An exercise machine comprising:

a resistance mechanism;

a supporting frame;

a movable member that is movable relative to the supporting frame into and between a rest position and an extended position, wherein movement of the movable member towards the extended position is resisted by the resistance mechanism;

a selector mechanism that facilitates adjustment of the rest position; and a stop device including an engagement member that operably engages a stop surface to stop the movable member in the rest position, wherein the engagement member is configured to translate along the stop surface during adjustment of the rest position via the selector mechanism.

2. The exercise machine according to claim 1, wherein the engagement member comprises a roller that is rollable along the stop surface.

3. The exercise machine according to claim 1, wherein the stop surface is planar.

4. The exercise machine according to claim 1, wherein the stop surface is convex.

5. The exercise machine according to claim 1, wherein the resistance mechanism comprises a pulley cable and further wherein the stop device is configured to maintain a substantially constant tension in the pulley cable when the engagement member translates along the stop surface.

6. The exercise machine according to claim 1, wherein the exercise machine is configured to vary a femur-to-spine angle of a user through a range between greater than or equal to 50 degrees and less than or equal to 109 degrees.

7. The exercise machine according to claim 1, wherein the exercise machine is configured for a user to perform a leg press exercise motion, wherein the supporting frame comprises at least one curved rail along which the movable member moves during said leg press exercise motion.

8. An exercise machine for performing a leg press exercise motion, the exercise machine comprising:

a resistance mechanism;

a supporting frame;

a seat on which a user can sit during performance of said leg press exercise motion, wherein the seat is movable along a curved path relative to the supporting frame into and between a rest position and an extended position, wherein movement of the seat towards the extended position is resisted by the resistance mechanism, a selector mechanism that facilitates adjustment of the rest position; and a stop device including an engagement member that operably engages a stop surface to stop the movable member in the rest position, wherein the engagement member is configured to translate along the stop surface during adjustment of the rest position via the selector mechanism.

9. The exercise machine according to claim 8, wherein the engagement member comprises a roller that is rollable along the stop surface.

10. The exercise machine according to claim 8, wherein the stop surface is planar.

11. The exercise machine according to claim 8, wherein the stop surface is convex.

12. The exercise machine according to claim 8, wherein the exercise machine is configured to vary a femur-to-spine angle of the user through a range between greater than or equal to 50 degrees and less than or equal to 109 degrees during said leg press exercise motion.

13. The exercise machine according to claim 8, wherein the supporting frame comprises at least one curved rail along which the seat moves during said leg press exercise motion.

14. The exercise machine according to claim 8, wherein the resistance mechanism comprises a pulley cable and further wherein the stop device is configured to maintain a substantially constant tension in the pulley cable when the engagement member is translated along the stop surface.

15. The exercise machine according to claim 14, wherein the resistance mechanism further comprises a weight stack, and wherein the pulley cable is coupled to the weight stack.

16. The exercise machine according to claim 8, wherein the selector mechanism comprises a selector bar and a spring-loaded pin device.

17. The exercise machine according to claim 8, further comprising a gas-spring assist mechanism that assists movement of the seat via the selector mechanism.

18. An exercise machine comprising:

a resistance mechanism;

a supporting frame;

a movable member that is movable relative to the supporting frame into and between a rest position and an extended position during performance of an exercise motion by a user, wherein movement of the movable member towards the extended position is resisted by the resistance mechanism; and a stop device that stops the movable member in the rest position, the stop device having an engagement member that engages and is able to translate along a stop surface on the supporting frame when the movable member is in the rest position;

wherein the engagement member is coupled to the movable member by a selector mechanism that facilitates adjustment of the movable member relative to the supporting frame without engaging the resistance mechanism, thereby permitting adjustment of a location of the rest position relative to the supporting frame.

19. An exercise machine for performing a leg press exercise motion, the exercise machine comprising:

a resistance mechanism;

a supporting frame;

a seat on which a user can sit during performance of said leg press exercise motion, wherein the seat is movable along a curved path relative to the supporting frame into and between a rest position and an extended position during performance of said leg press exercise motion, wherein movement of the seat towards the extended position is resisted by the resistance mechanism;

a stop device that stops the seat when the seat is in the rest position, the stop device having an engagement member that engages and is able to translate along a stop surface on the supporting frame; and a selector mechanism that facilitates adjustment of the seat relative to the supporting frame without engaging the resistance mechanism, thereby permitting adjustment of a location of the rest position relative to the supporting frame, wherein the engagement member is coupled to the seat by the selector mechanism, and wherein the selector mechanism comprises a selector bar and a spring-loaded pin device.

20. An exercise machine for performing a leg press exercise motion, the exercise machine comprising:

a resistance mechanism;

a supporting frame;

a seat on which a user can sit during performance of said leg press exercise motion, wherein the seat is movable along a curved path relative to the supporting frame into and between a rest position and an extended position during performance of said leg press exercise motion, wherein movement of the seat towards the extended position is resisted by the resistance mechanism, a stop device that stops the seat when the seat is in the rest position, the stop device having an engagement member that engages and is able to translate along a stop surface on the supporting frame;

a selector mechanism that facilitates adjustment of the seat relative to the supporting frame without engaging the resistance mechanism, thereby permitting adjustment of a location of the rest position relative to the supporting frame, wherein the engagement member is coupled to the seat by the selector mechanism; and a gas-spring assist mechanism that assists movement of the seat via the selector mechanism.

* * * * *